US011185963B2

(12) United States Patent
Teh

(10) Patent No.: US 11,185,963 B2
(45) Date of Patent: Nov. 30, 2021

(54) HAND-HELD POWER TOOL AND MECHANICAL STRIKING MECHANISM

(71) Applicant: Robert Bosch GmbH, Stuttgart (DE)

(72) Inventor: Cheu Chyong Teh, Penang (MY)

(73) Assignee: Robert Bosch GmbH, Stuttgart (DE)

( * ) Notice: Subject to any disclaimer, the term of this patent is extended or adjusted under 35 U.S.C. 154(b) by 451 days.

(21) Appl. No.: 15/554,322

(22) PCT Filed: Feb. 24, 2016

(86) PCT No.: PCT/EP2016/053842
§ 371 (c)(1),
(2) Date: Aug. 29, 2017

(87) PCT Pub. No.: WO2016/146354
PCT Pub. Date: Sep. 22, 2016

(65) Prior Publication Data

US 2018/0029206 A1 Feb. 1, 2018

(30) Foreign Application Priority Data

Mar. 17, 2015 (DE) ..... 102015204807.1

(51) Int. Cl.
*B25B 21/02* (2006.01)
*B25D 11/04* (2006.01)
*B25D 11/10* (2006.01)

(52) U.S. Cl.
CPC ..... *B25B 21/02* (2013.01); *B25B 21/026* (2013.01); *B25D 11/04* (2013.01); *B25D 11/104* (2013.01)

(58) Field of Classification Search
None
See application file for complete search history.

(56) References Cited

U.S. PATENT DOCUMENTS 2,712,254 A * 7/1955 Schodeberg ..... B25B 21/026 173/93.6
3,001,428 A * 9/1961 Sindelar ..... B25B 21/026 173/93.6
3,054,312 A * 9/1962 Zengerer ..... B25B 19/00 173/93.7

(Continued)

FOREIGN PATENT DOCUMENTS

CN 101618536 A 1/2010
CN 201534323 U 7/2010

(Continued)

OTHER PUBLICATIONS

International Search Report dated May 20, 2016, of the corresponding International Application PCT/EP2016/053842 filed Feb. 24, 2016.

*Primary Examiner* — Hemant Desai
*Assistant Examiner* — Tanzim Imam
(74) *Attorney, Agent, or Firm* — Norton Rose Fulbright US LLP; Gerard Messina

(57) ABSTRACT

In a hand-held power tool that includes a mechanical striking mechanism, including a drive shaft for rotatably driving a impactor associated with the mechanical striking mechanism, at least one V-shaped guide groove, whose base lines that converge into a connecting section have a concave-polygonal design, at least in sections, is provided on an outer circumference of the drive shaft.

9 Claims, 4 Drawing Sheets

(56) References Cited

U.S. PATENT DOCUMENTS

| | | | | |
|---|---|---|---|---|
| 3,207,237 | A * | 9/1965 | Wanner | B25B 21/02 173/93.5 |
| 6,733,414 | B2 * | 5/2004 | Elger | B25B 21/02 173/109 |
| 7,963,430 | B2 * | 6/2011 | Fukinuki | B25C 1/06 227/131 |
| 2002/0094907 | A1 * | 7/2002 | Elger | B25B 21/02 475/331 |
| 2014/0338942 | A1 * | 11/2014 | Putney | B25B 21/02 173/93 |

FOREIGN PATENT DOCUMENTS

| | | | |
|---|---|---|---|
| CN | 102905852 | A | 1/2013 |
| DE | 1109107 | B | 6/1961 |
| EP | 1120199 | A2 | 8/2001 |
| EP | 2168725 | A1 | 3/2010 |
| JP | 2001219383 | A | 8/2001 |
| JP | 3678965 | B2 * | 8/2005 |

* cited by examiner

HAND-HELD POWER TOOL AND MECHANICAL STRIKING MECHANISM

BACKGROUND INFORMATION

The present invention relates to a hand-held power tool that includes a mechanical striking mechanism, including a drive shaft for rotatably driving an impactor associated with the mechanical striking mechanism. Moreover, the present invention relates to a mechanical striking mechanism which includes an impactor that is provided with at least one drive cam, and an output shaft that is provided with at least one output cam, the at least one drive cam being designed for percussively driving the output cam in a percussion mode of the mechanical striking mechanism, and the impactor cooperating with a drive shaft.

A rotary impact tool is described in European Patent No. EP 2 168 725 A1, in which a drive shaft is rotatably driven by a rotary drive power source, the drive shaft having an outer circumferential surface and a cam groove that is formed on the outer circumferential surface. A hammer is situated coaxially with respect to the drive shaft, the hammer having an inner circumferential surface and a cam groove that is formed on the inner circumferential surface. In addition, the rotary impact tool includes an anvil that is engageable with the hammer along a rotation direction, and a compression spring for axially pretensioning the hammer in the direction of the anvil or an appropriate tool holder. For mechanical coupling between the drive shaft and the hammer, a ball is provided which engages with the cam groove of the drive shaft and with the cam groove of the hammer. The hammer is designed in such a way that it is able to rotate along a location line that is determined by the cam groove of the drive shaft and the cam groove of the hammer.

A location line of the hammer, viewed in the drive direction or output direction, has a curved shape, in which an angle of inclination of the location line varies continuously with the change in the hammer rotation angle.

One disadvantage of this device, among other things, is that due to the geometry of the cam grooves, a collision between the hammer cam and the anvil cam on the end-face or edge side, which increases wear, is possible. This means that the hammer and the anvil are frequently not synchronized with one another, i.e., are disengaged, during operation of the rotary impact tool as a function of its operating state.

SUMMARY

An object of the present invention, therefore, is to provide a hand-held power tool that includes a striking mechanism, in which the synchronization between an impactor and a drive shaft is ensured, at least for the most part in all operating states, and the hand-held power tool requires a reduced drive torque.

This object may be achieved by a hand-held power tool in accordance with the present invention, the hand-held power tool including a mechanical striking mechanism, including a drive shaft for rotatably driving an impactor associated with the mechanical striking mechanism. At least one V-shaped guide groove, whose base lines that converge into a connecting section in the output direction have a concave-polygonal design, at least in sections, is provided on an outer circumference of the drive shaft.

Thus, due to an improved profile geometry of the V-shaped guide grooves, the present invention allows improved synchronization between the drive cam and the output cam of the mechanical striking mechanism, so that in particular the risk of wear-increasing collisions between same on the end-face or edge side is significantly reduced. In addition, a mechanical drive torque required for operating the striking mechanism is reduced. The drive shaft that cooperates with the impactor is preferably driven by a grid- or battery-powered electric motor via a gear for rotational speed and torque adaptation.

A driver ball that engages with an entraining recess that is formed on an inner circumference of a through opening of the impactor is preferably situated in the at least one guide groove of the drive shaft.

A reliable mechanical coupling is thus provided between the drive shaft and the impactor, while maintaining the necessary relative movability for generating pulsating rotary percussive impacts that are required during operation.

In one advantageous embodiment, the connecting section between the base lines of the V-shaped guide groove has an at least essentially semicircular curvature.

The enlarged radius of the connecting section results in a reduction in the axial speed of the impactor.

According to one refinement, the connecting section has an enlarged radius.

The comparatively large radius results in an improved movement speed of the impactor over time.

The base lines on both sides of the connecting section preferably each have an essentially linear middle section having a first predefined angle of inclination that is preferably larger than 45°.

This results in a high axial acceleration of the impactor, and accordingly, a high impact energy.

The two middle sections are preferably each adjoined by an essentially linear end section having a second predefined angle of inclination that is preferably smaller than 45°.

The likelihood that the drive cams and the output cams will collide with one another on the end-face or edge side is thus significantly reduced.

In one advantageous embodiment, the first predefined angle of inclination is larger than the second predefined angle of inclination.

This results in optimal operating properties of the striking mechanism in the percussion mode.

According to one advantageous embodiment, two level curves situated in parallel and spaced apart from each base line of the V-shaped guide groove converge into a connecting point at an acute angle.

This results in reduced friction of the driver balls within the guide groove when they pass the connecting point.

The at least one V-shaped guide groove preferably has an essentially semicircular cross-sectional geometry.

This results in a linear contact, i.e., contact over a maximum surface area, between the driver ball and the associated guide groove or entraining recess.

According to one advantageous refinement, the at least one entraining recess has a hollow groove shape with a basis line that extends essentially corresponding to the base line.

This ensures reliable guiding of the driver balls between the drive shaft and the impactor in cooperation with the V-shaped guide groove.

Moreover, the object stated at the outset is achieved by a mechanical striking mechanism, which includes an impactor that is provided with at least one drive cam, and an output shaft that is provided with at least one output cam, the at least one drive cam being designed for percussively driving the output cam in a percussion mode of the mechanical striking mechanism, and the impactor cooperating with a drive shaft, at least one V-shaped guide groove, whose base lines that converge into a connecting section in the output direction have a concave-polygonal design, at least in sections, being provided on an outer circumference of the drive shaft.

Due to the polygonal-concave guide grooves according to the present invention, in addition to other positive effects, the drive torque to be applied by a drive motor for operating the striking mechanism may be reduced, and accordingly the service life of an impact screwdriver that is in particular powered by a rechargeable battery may be significantly increased. In addition, this results in improved synchronization between the drive cams and the output cams of the striking mechanism, resulting, among other things, in reduced wear and an increased service life.

BRIEF DESCRIPTION OF THE DRAWINGS

The present invention is explained in greater detail in the following description, with reference to exemplary embodiments that are illustrated in the figures.

DETAILED DESCRIPTION OF EXAMPLE EMBODIMENTS

Figure 1:
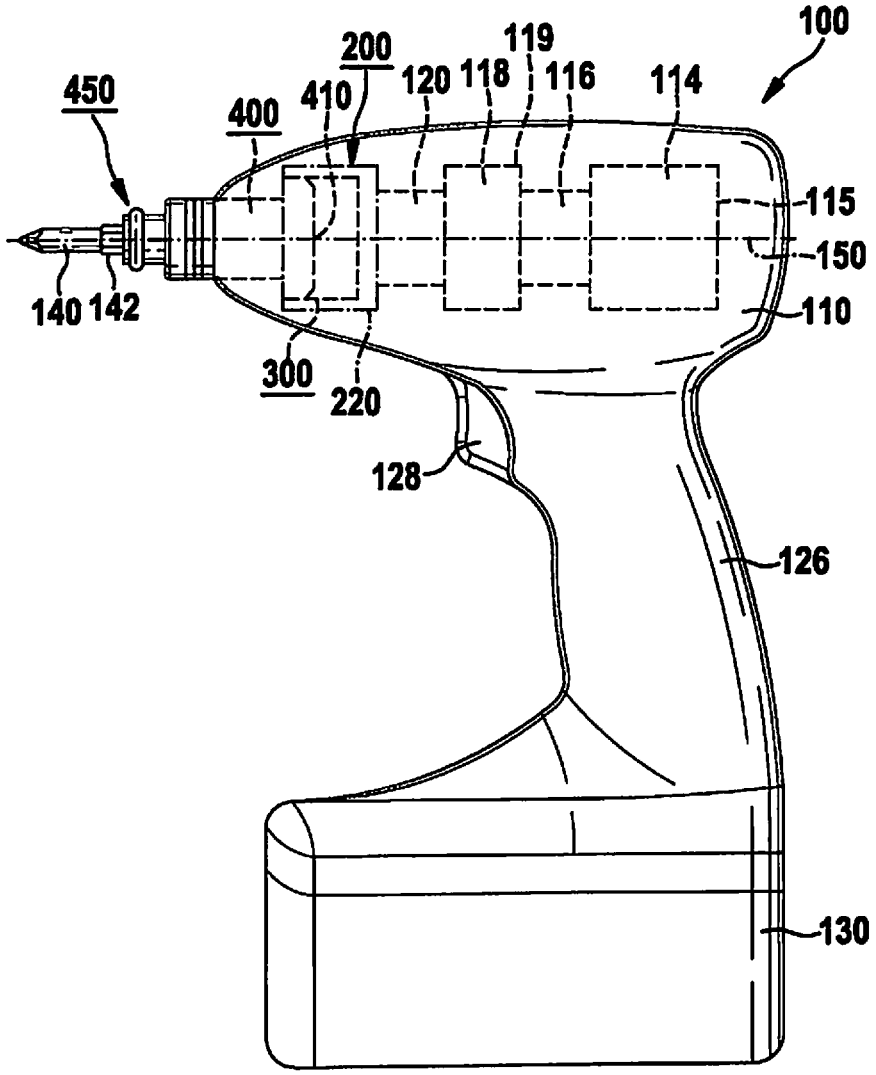
FIG. 1 shows a schematic illustration of a hand-held power tool that is equipped with a tool holder and a mechanical striking mechanism according to the present invention.

FIG. 1 shows a hand-held power tool 100 that is equipped with a tool holder 450 and a mechanical striking mechanism 200 according to the present invention. Hand-held power tool 100 includes a housing 110 with a handle 126, and according to one specific embodiment is mechanically and electrically connected to a rechargeable battery pack 130, which is preferably replaceable, for supplying power independently of the power grid.

Hand-held power tool 100 is designed as a cordless rotary impact screwdriver as an example. However, it is pointed out that the present invention is not limited to cordless rotary impact screwdrivers, and instead may be used for different power tools in which a tool is set in rotation and a striking mechanism according to the present invention is employed, for example in an impact drill, etc., regardless of whether the power tool is operable independently of the power grid with a rechargeable battery pack, or with power from the grid. It is further pointed out that the present invention is not limited to motor-operated hand-held power tools.

An electric drive motor 114 that is supplied with power by rechargeable battery pack 130, a gear 118, and striking mechanism 200 are situated in housing 110. Drive motor 114 is actuatable, i.e., switchable on and off, via a manual switch 128, for example, and may be any type of motor, such as an electronically commutated motor or a direct current motor. Drive motor 114 is preferably electronically controllable or regulatable in such a way that operation in reverse as well as specification of a desired rotation speed are achievable. The mode of operation and the design of a suitable drive motor are well known from the related art, and for the purpose of brevity of the description are therefore not described here in greater detail.

Drive motor 114 is preferably connected via an associated motor shaft 116 to gear 118, which converts a rotation of motor shaft 116 into a rotation of a drive shaft 120 provided between gear 118 and striking mechanism 200. This conversion preferably takes place in such a way that drive shaft 120 rotates relative to motor shaft 116 with increased torque but at a reduced rotational speed. In the illustration, drive motor 114 is situated in a motor housing 115 and gear 118 is situated in a gear housing 119; gear housing 119 and motor housing 115 are situated in housing 110 by way of example.

Mechanical striking mechanism 200 coupled to drive shaft 120 is, by way of example, a rotary or rotational striking mechanism that is situated in an optional striking mechanism housing 220 and includes an impactor 300 that generates rapid, high-intensity rotary pulses and transmits them via an output cam system 410 to an output shaft 400, for example an output spindle. However, it is pointed out that use of optional striking mechanism housing 220 is strictly by way of example, and is not intended to be limiting to the present invention. Rather, the present invention may also be used for striking mechanisms without a separate striking mechanism housing, and which are situated, for example, directly in housing 110 of hand-held power tool 100. In addition, the mode of operation and the design of a suitable striking mechanism are described in, for example, German Patent Application No. DE 20 2006 014 850 U1, and for the purpose of brevity of the description are therefore not described in greater detail here, with the exception of the elements shown and described below with reference to FIGS. 2 through 7. However, at this point explicit reference is made to German Patent Application No. DE 20 2006 014 850 U1, the disclosure of which is regarded as an inherent part of the present description expressly (i.e., expressly incorporated herein by reference in its entirety), and from which one specific embodiment of an example of a striking mechanism may be derived.

Tool holder 450, which is preferably designed for accommodating insertion tools, and which according to one specific embodiment is connectable at least to an insertion tool 140 with an external polygon coupling 142, but preferably also connectable to an insertion tool with an internal polygon coupling, for example a socket wrench, is preferably provided on output shaft 400. Insertion tool 140 is designed by way of example as a screwdriver bit with external polygon coupling 142, which is a hexagon coupling in the illustration, and is situated in a suitable internal mounting of tool holder 450. This type of screwdriver bit, as well as a suitable socket wrench, are well known from the related art, so that a detailed description is dispensed with here for the purpose of brevity of the description.

Impactor 300 is preferably axially pretensioned in the direction of tool holder 450 or of output shaft 400 with the aid of a compression spring, not illustrated. In the illustration, output shaft 400 together with tool holder 450, as well as striking mechanism 200, drive shaft 120, gear 118, motor shaft 116, and drive motor 114 are situated along a longitudinal center axis 150 in housing 110 of hand-held power tool 100.

Figure 2:
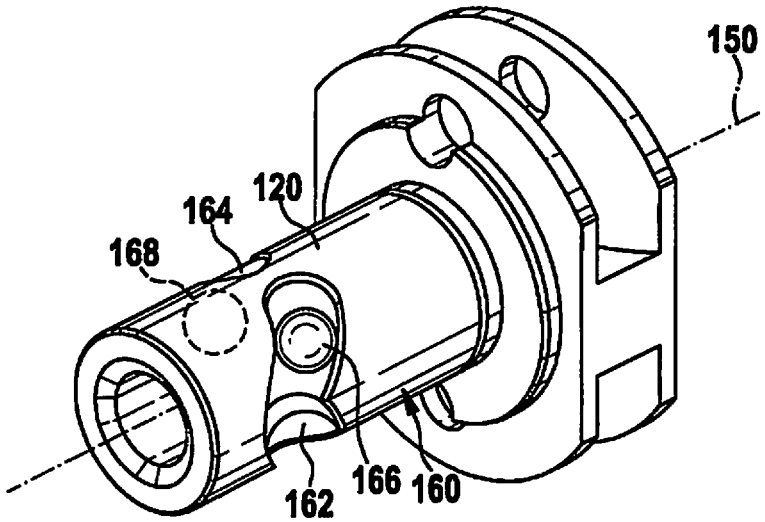
FIG. 2 shows a perspective partial view of a drive shaft having two V-shaped guide grooves.

FIG. 2 shows drive shaft 120 from FIG. 1, which according to one specific embodiment includes two at least essentially V-shaped guide grooves 162, 164. These V-shaped guide grooves 162, 164 are preferably provided in a preferably cylindrical outer circumference 160 of drive shaft 120, which according to one specific embodiment has a hollow cylindrical design, at least in sections, and extends coaxially with respect to longitudinal center axis 150 from FIG. 1. The hollow cylindrical section of drive shaft 120 is used, for example, for accommodating a guide element or guide mandrel of output shaft 400 from FIG. 1.

V-shaped guide grooves 162, 164 each preferably have an essentially C-shaped and preferably semicircular cross-sectional geometry. A driver ball 166, 168 is accommodated in each guide groove 162, 164. The two driver balls 166, 168 are preferably each situated in V-shaped guide grooves 162, 164, preferably up to the maximum of their equatorial circumferences.

Figure 3:
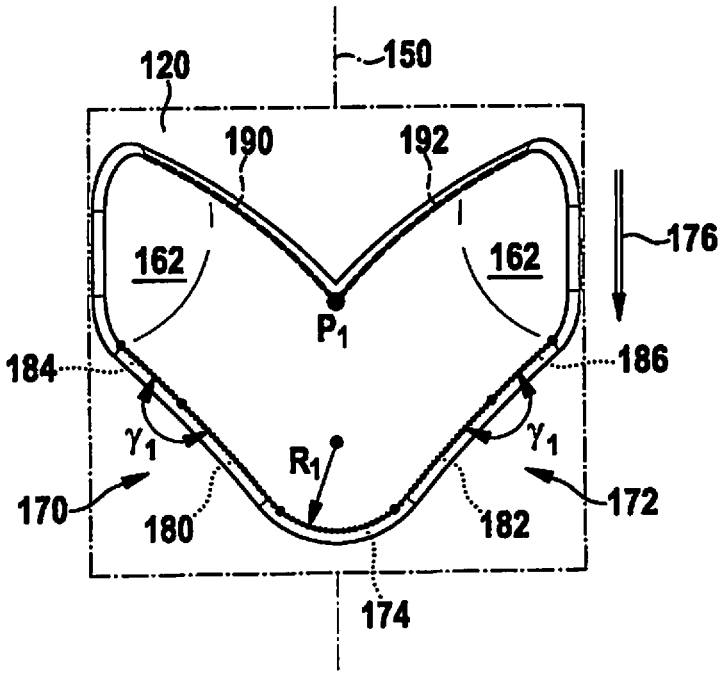
FIG. 3 shows a top view onto a V-shaped guide groove of the drive shaft from FIG. 2.

FIG. 3 shows drive shaft 120 from FIG. 2 for explaining V-shaped guide groove 162 from FIG. 2, which is designed according to one specific embodiment. V-shaped guide groove 162 preferably has two base lines 170, 172 which preferably converge into an arched, preferably at least approximately semicircular, connecting section 174 that points in an output direction 176 of drive shaft 120. Connecting section 174 has a radius $R_1$ in the illustration.

Base lines 170, 172, which extend symmetrically with respect to longitudinal center axis 150 from FIG. 1, have a middle section 180, 182 which is preferably at least approximately linear and which adjoins connecting section 174 on each side. Each middle section is adjoined by an end section 184, 186, which once again is preferably at least approximately linear, at an obtuse or straight angle $\gamma_1$ that is different from 180°. According to the present invention, base lines 170, 172 thus have a concave-polygonal profile, at least in sections; i.e., base lines 170, 172 represent two polygonal lines which are "bent" toward one another or extend toward one another in the direction of longitudinal center axis 150. Level curves 190, 192, which preferably converge at an acute angle into a connecting point $P_1$ situated opposite from connecting section 174, extend in parallel to and spaced apart from the two base lines 170, 172 of V-shaped guide groove 162.

Figure 4:
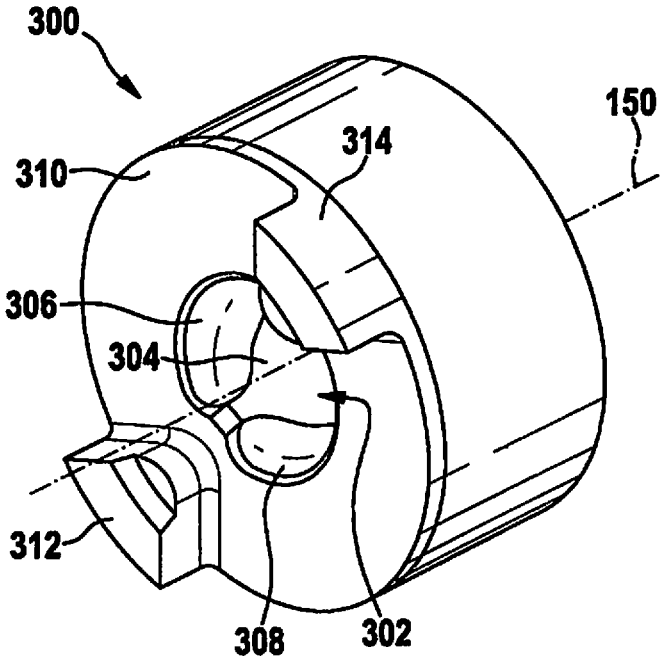
FIG. 4 shows a perspective view of an impactor having a through opening.

FIG. 4 shows preferably cylindrical, solid impactor 300 from FIG. 1, which according to one specific embodiment has a preferably cylindrical through opening 302. This through opening preferably coaxially surrounds longitudinal center axis 150 from FIG. 1. Two entraining recesses 306, 308 are preferably provided in an inner circumference 304 of through opening 302, and preferably each have an approximately C- or L-shaped, preferably semicircular, cross-sectional geometry for accommodating a driver ball 166, 168 from FIG. 2, preferably up to the maximum of their equatorial circumferences.

Preferably two drive cams 312, 314 designed as axial projections are formed, preferably integrally, on an end-face side 310, which is circular in the illustration, of impactor 300, and according to one specific embodiment are positioned on both sides of through opening 302 and diametrically opposite one another. Drive cams 312, 314 cooperate in a suitable manner with two output cams, not illustrated, of the striking mechanism to form output cam system 410 from FIG. 1.

Figure 5:
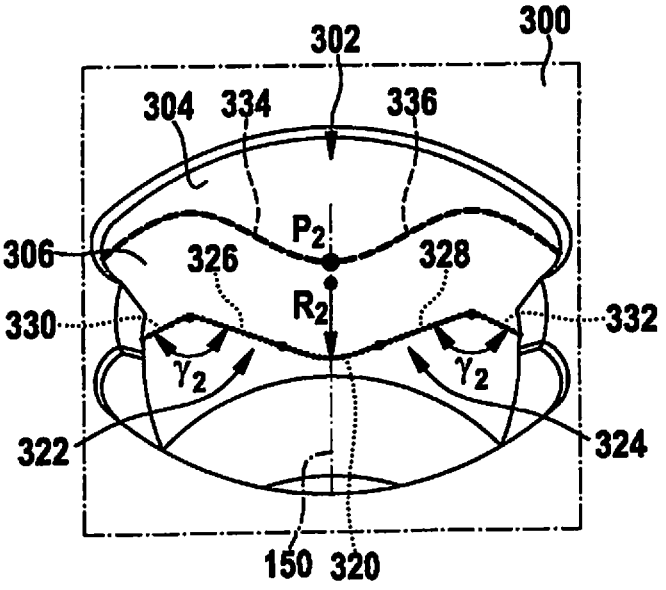
FIG. 5 shows a perspective partial view of the impactor from FIG. 4, with an entraining recess.

FIG. 5 shows impactor 300 from FIG. 4 for explaining entraining recess 306 from FIG. 4, which is designed according to one specific embodiment. The entraining recess is preferably formed in inner circumference 304 of through opening 302, which preferably extends centrally with respect to longitudinal center axis 150, in impactor 300.

Entraining recess 306 preferably has a design that corresponds to V-shaped guide groove 162 and 164 from FIG. 2 which cooperates with it, and includes an arched, preferably at least approximately semicircular, connecting section 320, having a radius $R_2$, which is adjoined on each side by a basis line 322, 324. Each basis line includes a linear middle section 326, 328, which preferably merges into a likewise linear end section 330, 332 at an obtuse or straight angle $\gamma_2$ that is different from 180°. Two approximately S-shaped level curves 334, 336 situated in parallel and spaced apart from basis lines 322, 324 converge at an acute angle into a connecting point $P_2$ situated opposite from connecting section 320.

The same applies for the geometrical configuration of second entraining recess 308 from FIG. 4 (concealed here), which is preferably situated diametrically opposite from entraining recess 306. Radii $R_1$ of V-shaped guide grooves (see FIGS. 2 and 3) and radii $R_2$ of entraining recesses 306, 308 are preferably of equal dimensions.

Figure 6:
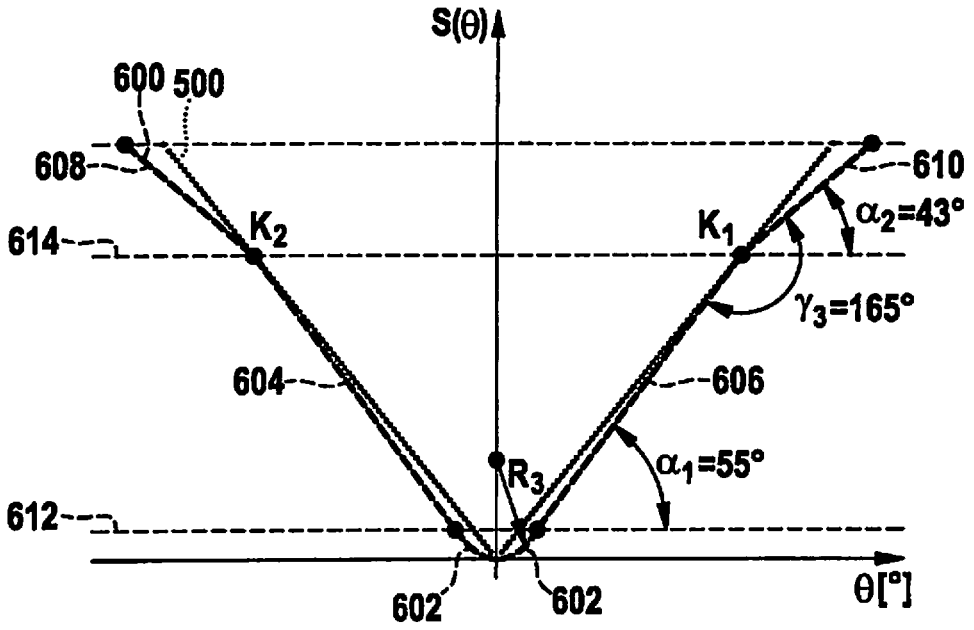
FIG. 6 shows a measurement diagram in which an axial displacement of the impactor from FIGS. 4 and 5 that results from the guide groove geometry according to the present invention is plotted as a function of a rotation angle between the drive shaft from FIGS. 2 and 3 and the impactor, in each case for a conventional linear guide groove and a concave-polygonal guide groove according to the present invention.

FIG. 6 shows a measurement diagram in which an axial displacement $S(\theta)$ of impactor 300 from FIGS. 4 and 5, which results from the guide groove geometry according to the present invention, is plotted as a function of a rotation angle $\theta$ between drive shaft 120 from FIGS. 2 and 3 and impactor 300, in each case for a conventional linear guide groove and for concave-polygonal guide groove 162 and 164 according to the present invention from FIGS. 2 and 3. It is apparent that in the case of the conventional linear guide groove (indicated by a dotted graph line 500), an axial displacement of impactor 300 results which in comparison to guide groove 162 and 164 according to the present invention from FIGS. 2 and 3 (indicated by a dashed line 600), which is concave-polygonal at least in sections, is smaller in each case, and is approximately equal only at two (inflection) points $K_{1,2}$ of graph line 500, as a function of rotation angle $\theta$ plotted on a horizontal coordinate axis. The two graph lines 500, 600 each extend mirror-symmetrically with respect to the vertical coordinate axis on which axial displacement $S(\theta)$ is plotted.

The curve of graph line 600 results from the above-described guide groove geometry of concave-polygonal guide grooves 162 and 164 from FIGS. 2 and 3, and therefore likewise includes an arched connecting section 602, having a radius $R_3$, which corresponds to connecting section 174 from FIG. 3 and which is adjoined on each side by an at least approximately linear middle section 604, 606, these middle sections 604, 606 corresponding to middle sections 180, 182 from FIG. 3. An angle $\alpha_1$ between an illustrated horizontal 612, i.e., a first parallel line with respect to the horizontal coordinate axis in the illustration, and two middle sections 604, 606 is preferably larger than 45°, and in the illustration is approximately 55° in each case. This angle $\alpha_1$ is preferably larger than an angle $\alpha_2$ between a corresponding horizontal 614, i.e., a second parallel line with respect to the horizontal coordinate axis in the illustration, and two end sections 608, 610 which correspond to end sections 184, 186 from FIG. 3, and is preferably smaller than 45°, and in the illustration is approximately 43°. This also results in the two end sections 608, 610 adjoining middle sections 604, 606 at two (inflection) points $K_{1,2}$, in each case at an angle $\gamma_3$ that is different from 180°. This obtuse or straight angle $\gamma_3$ is preferably approximately 165°. Radius $R_3$ preferably corresponds to radii $R_{1,2}$ of V-shaped and concave-polygonal guide grooves 162 and 164 from FIGS. 2 and 3 of drive shaft 120 from FIG. 2, or to entraining recesses 306, 308 from FIG. 4 of impactor 300 from FIGS. 4 and 5. The same applies for the three angles angle $\iota_{1,2,3}$ (see in particular FIGS. 3 and 5).

Figure 7:
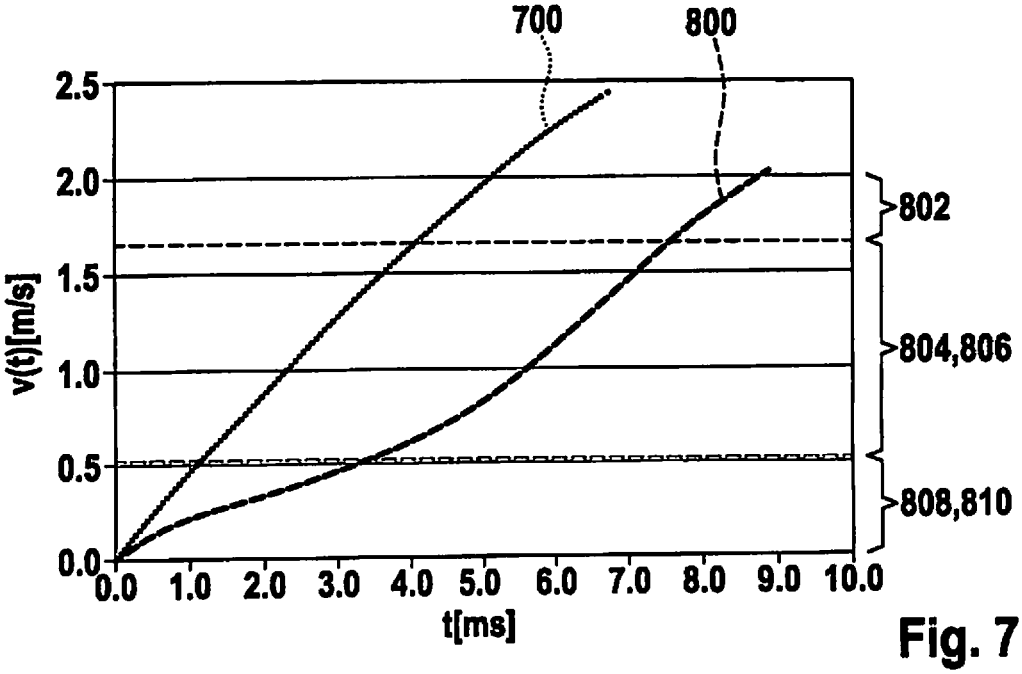
FIG. 7 shows a measurement diagram in which the axial speed of the impactor from FIGS. 4 and 5 that results from the guide groove geometry according to the present invention is illustrated as a function of time t in each case for the conventional linear guide groove and the concave-polygonal guide groove according to the present invention.

FIG. 7 illustrates another measurement diagram in which an axial speed v(t) of impactor 300 from FIGS. 4 and 5, resulting from the guide groove geometry according to the present invention, is plotted as a function of time t, in each case for a conventional linear guide groove and concave-polygonal guide groove 162 and 164 from FIGS. 2 and 3. It is apparent that for the conventional, linear guide groove (indicated by a dotted graph line 700), an axial speed v(t) of impactor 300 from FIGS. 4 and 5 results which in comparison to guide groove 162 and 164 from FIGS. 2 and 3 (indicated by a dashed curve 800), which according to the present invention is concave-polygonal at least in sections, is always smaller, as a function of time t plotted on a horizontal coordinate axis. Section 802, sections 804, 806, and sections 808, 810 of graph line 800 correspond to connecting section 602, middle sections 604, 606, and end sections 608, 610 of graph line 600 from FIG. 6.

Guide grooves 162 and 164 from FIGS. 2 and 3, which are polygonal-concave according to the present invention, at least in sections, result in particular in a smaller increase in axial speed v(t) of impactor 300 from FIGS. 4 and 5 over time t, which results, among other things, in a lower number and reduced severity of collision situations between the drive cams and the output cams of striking mechanism 200 from FIG. 1. This results in running behavior of striking mechanism 200 from FIG. 1 which is smoother and at the same time lower in wear, and which is thus associated with a significant increase in the operating comfort of hand-held power tool 100 from FIG. 1. In addition, striking mechanism 200 of hand-held power tool 100 from FIG. 1, provided with guide grooves 162 and 164 from FIGS. 2 and 3 which are concave-polygonal, at least in sections, requires lower drive torques, so that in the case of a hand-held power tool that is supplied with power independently of the power grid, a longer operating time of electric drive motor 114 from FIG. 1 is possible without interim replacement of rechargeable battery pack or interim charging of rechargeable battery pack 130 from FIG. 1.

What is claimed is:

1. A hand-held power tool, comprising:

a mechanical striking mechanism including a drive shaft for rotatably driving an impactor associated with the mechanical striking mechanism;

wherein at least one V-shaped guide groove having base lines converging into a connecting section in an output direction of the drive shaft and having a concave-polygonal design, at least in sections, is provided on an outer circumference of the drive shaft, wherein the base lines extend symmetrically with respect to a longitudinal center axis of the hand-held power tool, wherein the base lines represent two lines which are at least one of bent or extending toward one another in a direction of the longitudinal center axis, at least in sections, wherein the base lines on both sides of the connecting section each have a linear middle section having a first predefined angle of inclination that is larger than 45°, and wherein the two middle sections are each adjoined by a linear end section having a second predefined angle of inclination that is smaller than 45°.

2. The hand-held power tool as recited in claim 1, wherein a driver ball that engages with at least one entraining recess that is formed on an inner circumference of through opening of the impactor is situated in the at least one guide groove of the drive shaft.

3. The hand-held power tool as recited in claim 2, wherein the at least one entraining recess has a hollow groove shape with a basis line that extends correspondingly to at least one of the base lines.

4. The hand-held power tool as recited in claim 1, wherein the connecting section between the base lines of the at least one V-shaped guide groove has a semicircular curvature.

5. The hand-held power tool as recited in claim 4, wherein the base lines are bent into the connecting section.

6. The hand-held power tool as recited in claim 1, wherein the connecting section has an enlarged radius.

7. The hand-held power tool as recited in claim 1, wherein two level curves situated in parallel and spaced apart from each base line of the at least one V-shaped guide groove converge into a connecting point at an acute angle.

8. The hand-held power tool as recited in claim 7, wherein the at least one of the V-shaped guide groove has a semicircular cross-sectional geometry.

9. The hand-held power tool as recited in claim 1, wherein the drive shaft has a hollow cylindrical design, at least in sections, and extends coaxially with respect to the longitudinal center axis.

* * * * *